United States Patent [19]

Morgenthaler et al.

[11] Patent Number: 5,061,212

[45] Date of Patent: Oct. 29, 1991

[54] SHIP DRIVE WITH VARIABLE-PITCH PROPELLER

[76] Inventors: Urs Morgenthaler, Seeblick, CH-8832 Wollerau; Peter Müller, Isengrund 9, CH-8134 Adliswil, both of Switzerland

[21] Appl. No.: 614,811

[22] Filed: Nov. 16, 1990

[30] Foreign Application Priority Data

Nov. 21, 1989 [DE] Fed. Rep. of Germany ..... 3938567

[51] Int. Cl.[5] ..... B63H 3/08; B63H 3/10

[52] U.S. Cl. ..... 440/50; 416/25; 416/30; 416/157 R

[58] Field of Search ..... 440/1, 50; 416/25, 27, 416/44 R, 44 A, 147, 156, 157 R, 157 A, 157 B, 158, 30

[56] References Cited

U.S. PATENT DOCUMENTS 2,986,221 5/1961 Liaaen ..... 416/25 X
3,088,523 5/1963 Smalley et al. ..... 416/27 X
3,110,348 11/1963 Greiner ..... 416/27
3,802,800 4/1974 Merkx et al. ..... 416/157 R
4,588,354 5/1986 Duchesneau et al. ..... 416/27

*Primary Examiner*—Sherman Basinger
*Attorney, Agent, or Firm*—Herbert Dubno

[57] ABSTRACT

A variable-speed propeller in a ship drive has the hydraulic valves feeding the working chambers of the hydraulic drive for the variable-speed propeller formed as electromagnetic valves controlled by timing relays which can be switched by a rocker switch or push-button switches to adjust the propeller pitch by an angular increment controlled by the "on" time of the relays. The engine speed is detected and, when the engine speed exceeds the maximum speed of the engine, the relay associated with increased pitch is triggered to obtain an increment of engine-speed reduction, thereby preventing the system from inadvertently having the blade pitch reduced when the engine is at maximum speed.

9 Claims, 2 Drawing Sheets

SHIP DRIVE WITH VARIABLE-PITCH PROPELLER

FIELD OF THE INVENTION

Our present invention relates to a ship or boat drive with a variable-pitch propeller and, more particularly, to a drive for a boat which comprises a motor, generally an internal-combustion engine, whose output shaft is connected to a variable-pitch propeller having a hydraulic pitch-adjustment system which can include a pitch-adjustment command element actuatable by the operator to adjust the pitch of the propeller.

BACKGROUND OF THE INVENTION

A boat drive of this type is described, for example, in European patent document EP 01 54 954, and here the pitch-adjustment command element is a control lever at the operating post of the ship which actuates the hydraulic-adjusting system or its valves.

Since ship drives having a motor and a variable-pitch propeller are sensitive systems which should be operated in as error-free manner as is possible, various control systems have been proposed for them (see German patent document 39 01 137). Such controls have been found to be rather complex and expensive, requiring repair and maintenance only by qualified personnel and in qualified maintenance facilities.

OBJECTS OF THE INVENTION

It is the principal object of the present invention to provide a structurally simple and reliable control system for a boat drive having a variable-pitch propeller which, in addition, is provided with fail-safe means to prevent errors in use.

Another object of the invention is to provide an improved boat or ship drive having a variable-pitch propeller whereby drawbacks of prior art systems are avoided.

SUMMARY OF THE INVENTION

These objects and others which will become apparent hereinafter are attained, in accordance with the invention, in a control system for a boat or ship drive with a motor and a variable-pitch propeller whose blade pitch is adjustable by means of a hydraulic-adjustment mechanism and whereby the working compartments of the hydraulic motor of this mechanism are fed by valves controlled by a pitch-adjustment command element.

According to the invention, the valves are formed as magnetic valves, each of which is provided with a timing relay energized by the pitch-adjustment command element, while the motor is provided with a rotary-speed measurement unit or sensor, e.g. a tachometer which, upon detecting a speed above a predetermined motor speed, actuates the timing relay for the magnetic valve assigned to increasing the blade pitch.

More specifically, the invention is a boat drive which comprises:

a drive motor;

a variable-pitch propeller connected to the motor and provided with a hydraulic pitch adjuster including a hydraulic motor having first and second working chambers respectively pressurizable to increase and to decrease propeller pitch respectively;

pitch-adjustment command element actuatable for varying propeller pitch;

first and second electromagnetic valves hydraulically connected to the first and second working chambers to control pressurization thereof upon electrical excitation of the valves;

first and second timing relays respectively connected electrically to the first and second electromagnetic valves for electrical excitation thereof and provided with means for energization of the relays selectively by operation of the pitch-adjustment command element; and means for measuring a rotary speed of the motor operatively connected to the first relay controlling the first valve for pressurizing the first working chamber to automatically increase propeller pitch independently of operation of the pitch-adjustment command element upon the speed exceeding a predetermined speed of the motor.

Especially advantageous is a system according to the invention in which the tachometer operates the timing relay associated with increased blade pitch when the speed of the motor exceeds the maximum speed thereof.

With the control system of the invention, the boat operator can adjust the pitch of the propeller for all operating conditions by actuation of the command element.

The command element need merely be a push-button arrangement or a rocker switch which can be briefly tapped or actuated to obtain an incremental adjustment of the blade pitch as controlled by the timing of the respective relay. Each actuation of the command element can bring about a change of pitch of one-half to one degree in a preferred embodiment of the invention and this can be achieved with an on-time of the timing relay of 50 to 200 msec.

Since each change in the pitch of the blade results in a reaction at the motor in the sense of an increase or decrease of its speed and, a racing of the motor can be highly detrimental, the speed-measuring unit which actuates the timing relay associated with increased pitch automatically responds when the maximum speed of the engine is reached to effect the increased pitch adjustment of the propeller. This occurs independently of the operation of the pitch-command element so that, should the operator of the ship inadvertently attempt to decrease the blade pitch when the motor is operated at its maximum speed, the pitch will automatically be decreased preferably so that the engine speed will decrease in increments of about 300 revolutions per minute.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
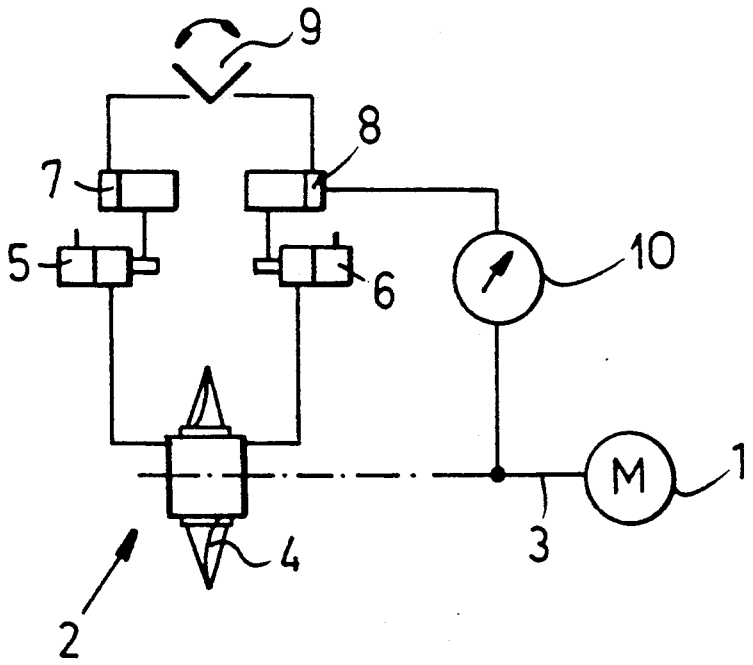
FIG. 1 is a highly diagrammatic representation of the functional interrelationships of the parts of the control system of the invention.

In the following description, reference numerals used in FIG. 1 also appear in FIG. 2 to indicate similarly functioning elements.

Referring first to FIG. 1, it can be seen that the invention provides a control for a boat drive having a motor 1 and a variable-pitch propeller 2. The variable-pitch propeller can be any of those described in the previously-mentioned references or in U.S. Pat. No 3,802,800.

The motor 1 can be an internal-combustion engine which is connected by its shaft 3 to the variable-speed propeller 2. The variable-speed propeller has integrated therein a hydraulic-control mechanism for adjusting the pitch of the blade (see the last-mentioned patent) and which is coupled by means, not shown, to the propeller blades 4. Each working chamber of the hydraulic adjustment mechanism has a magnetic valve 5, 6 upstream thereof controlling the flow to the respective working chamber.

The magnetic valves 5, 6 are, in turn, electrically controlled by timing relays 7, 8 which maintain their "on" states for predetermined intervals and can be directed to the "on" state by electrical pulses from a command element, here shown as a rocker switch 9.

Upon actuation of the timing relay 7, the magnetic valve 5 is opened for a predetermined duration, for example 50 to 200 msec, and the pitch of the blades 4 is reduced by an increment of one-half to one degree.

Upon actuation of the timing relay 8, the magnetic valve 6 opens for a corresponding period and the pitch of the blades 4 is increased by one-half to one degree.

As security against overrunning of the motor, a tachometer 10 measures the motor speed and upon this motor speed exceeding the maximum speed of the motor 1, a signal is provided to the timing relay 8 to trigger the latter for the incremental duration described which increases the pitch of the blades 4 by the increment of one-half to on degree independently of any operation of the command element and results in a reduction in the motor speed by a corresponding increment, say 300 revolutions per minute.

Figure 2:
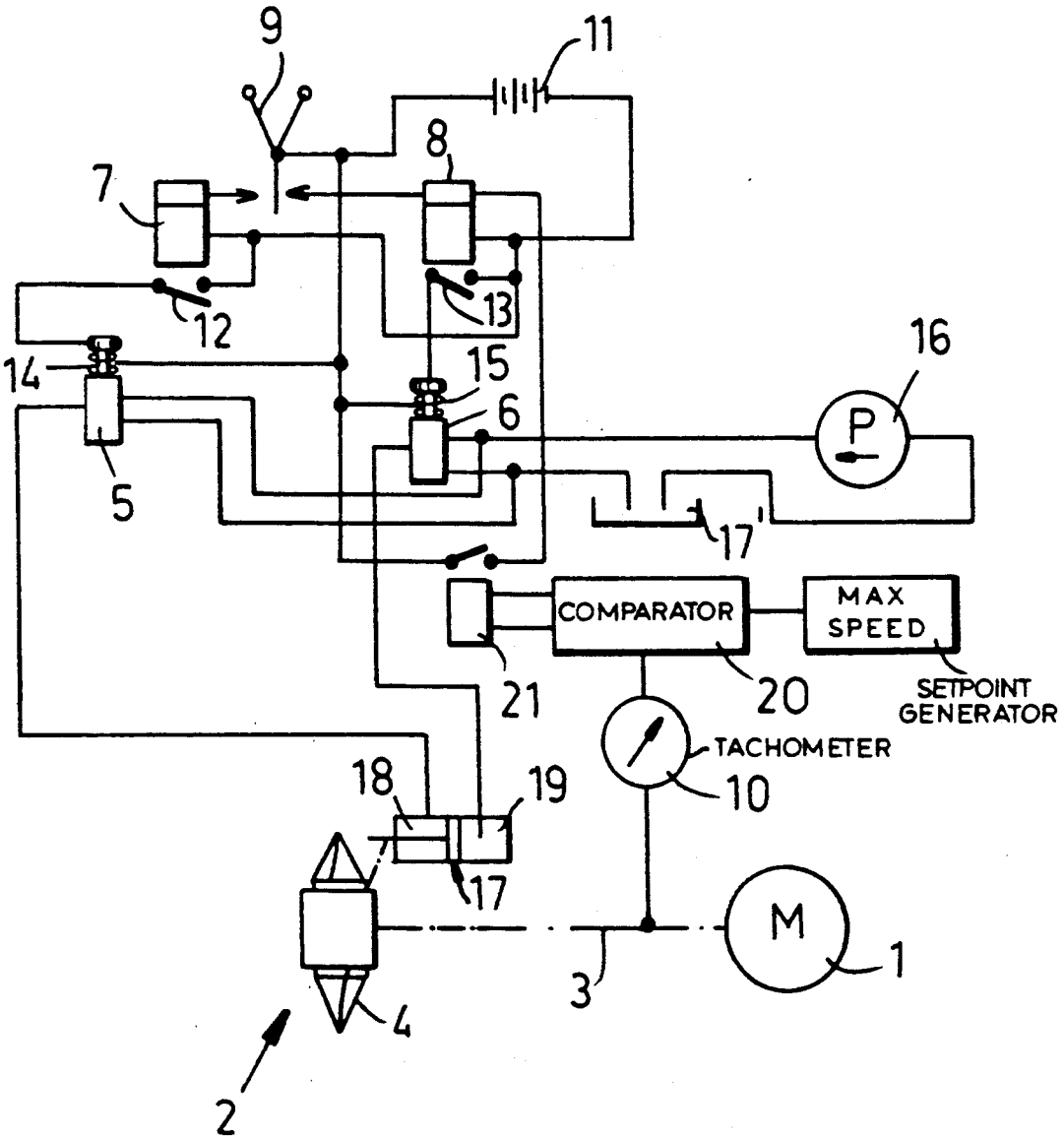
FIG. 2 is a more detailed illustration of the control system in diagrammatic form.

The system of FIG. 2 operates precisely in this manner but is shown in greater detail. Thus the switch 9 is shown to be connected between a source 11 of electrical energy and the relays 7 and 8 whose switches 12 and 13 are connected in series with this source and the electromagnetic coils 14 and 15 of the respective valves 5 and 6. The valves 5 and 6 are supplied with hydraulic fluid by, for example, a pump 16 connected to a reservoir 17.

In FIG. 2, the internal hydraulic mechanism for adjustment of the propeller blade pitch is shown to comprise a hydraulic motor 17 having the working chambers 18 and 19 to which the valves 5 and 6 are connected. In addition, FIG. 2 shows that the output of the electronic tachometer 10 can be applied to a comparator 20 providing an output to a relay 21 which briefly switches the relay 8 to its "on" state and thereby causes the increment in engine speed reduction in the manner described.

Figure 3:
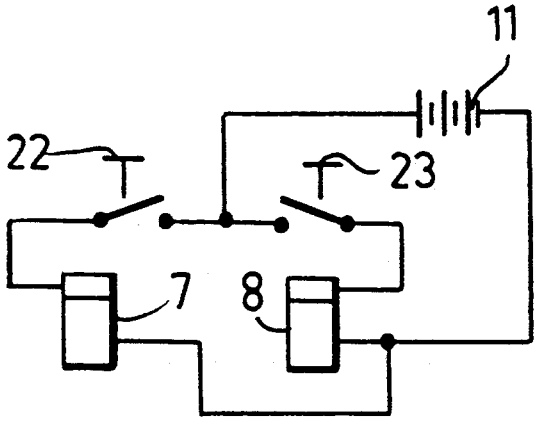
FIG. 3 is a diagram of a portion of the control system showing the use of push buttons.

In FIG. 3, we have shown a system in which the command element is formed by push buttons 22 and 23 which energizes the relays 7 and 8 in the manner described.

We claim:

1. A boat drive, comprising:

a drive motor;

a variable-pitch propeller connected to said motor and provided with a hydraulic pitch adjuster including a hydraulic motor having first and second working chambers respectively pressurizable to increase and to decrease propeller pitch respectively;

a pitch-adjustment command element actuatable for varying propeller pitch;

first and second electromagnetic valves hydraulically connected to said first and second working chambers to control pressurization thereof upon electrical excitation of said valves;

first and second timing relays respectively connected electrically to said first and second electromagnetic valves for electrical excitation thereof and provided with means for energization of said relays selectively by operation of said pitch-adjustment command element; and means for measuring a rotary speed of said motor operatively connected to said first relay controlling said first valve for pressurizing said first working chamber to automatically increase propeller pitch independently of operation of said pitch-adjustment command element upon said speed exceeding a predetermined speed of said motor.

2. The boat drive defined in claim 1 wherein said predetermined speed is a maximum speed of said motor.

3. The boat drive defined in claim 1 wherein said pitch-adjustment command element, said relays and said valves are constructed and arranged for an alteration of propeller pitch by ½° to 1° upon each actuation of said pitch-adjustment command element.

4. The boat drive defined in claim 1 wherein said relays have a switch on-time duration of 50 to 200 msec.

5. The boat drive defined in claim 1 wherein said pitch-adjustment command element comprises push-buttons.

6. The boat drive defined in claim 1 wherein said pitch-adjustment command element is a rocker switch.

7. The boat drive defined in claim 6 wherein said predetermined speed is a maximum speed of said motor.

8. The boat drive defined in claim 7 wherein said pitch-adjustment command element, said relays and said valves are constructed and arranged for an alteration of propeller pitch by ½° to 1° upon each actuation of said pitch-adjustment command element.

9. The boat drive defined in claim 8 wherein said relays have a switch on-time duration of 50 to 200 msec.

* * * * *